US011175078B2

(12) United States Patent
Kimura et al.

(10) Patent No.: US 11,175,078 B2
(45) Date of Patent: Nov. 16, 2021

(54) GAS-LIQUID SEPARATOR AND AIR CONDITIONER INCLUDING THE SAME

(71) Applicant: FUJITSU GENERAL LIMITED, Kanagawa (JP)

(72) Inventors: Takashi Kimura, Kanagawa (JP); Kazuki Suda, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 130 days.

(21) Appl. No.: 16/466,210

(22) PCT Filed: Sep. 21, 2017

(86) PCT No.: PCT/JP2017/034092
§ 371 (c)(1),
(2) Date: Jun. 3, 2019

(87) PCT Pub. No.: WO2018/105199
PCT Pub. Date: Jun. 14, 2018

(65) Prior Publication Data
US 2020/0064034 A1 Feb. 27, 2020

(30) Foreign Application Priority Data
Dec. 5, 2016 (JP) ..... JP2016-235504

(51) Int. Cl.
*F25B 43/00* (2006.01)
*F24F 1/32* (2011.01)
*F24F 1/42* (2011.01)

(52) U.S. Cl.
CPC ..... *F25B 43/006* (2013.01); *F24F 1/32* (2013.01); *F24F 1/42* (2013.01)

(58) Field of Classification Search
CPC ..... F25B 43/006; F25B 13/00; F25B 31/004; F25B 2313/0233; F25B 2313/0314;
(Continued)

(56) References Cited

U.S. PATENT DOCUMENTS 4,187,695 A * 2/1980 Schumacher ..... F25B 41/00 62/116
5,247,813 A * 9/1993 Bottum ..... F25B 43/006 116/276

(Continued)

FOREIGN PATENT DOCUMENTS

CN 1181464 A 5/1998
CN 2807158 Y 8/2006

(Continued)

OTHER PUBLICATIONS

Uki et al., Design of Gas-Liquid Separator for Complete Degasing; Dec. 2012, International Journal of Chemical Engineering and Applications, vol. 3 (Year: 2012).*

(Continued)

*Primary Examiner* — Emmanuel E Duke
(74) *Attorney, Agent, or Firm* — Paratus Law Group, PLLC

(57) ABSTRACT

In an air conditioner, an inlet pipe penetrates a location that is offset towards an outer circumferential side from an apex portion of a top portion. The suction pipe penetrates a location that is offset towards the outer circumferential side from an apex portion of a bottom portion and is inserted into the interior of the main body portion, and the suction inner pipe, which constitutes a portion of the suction pipe that lies in the interior of the main body portion, extends as far as an upper portion of the main body portion so that an inlet port is disposed in a space defined by the top portion. Then, the suction inner pipe includes a bend portion that is bent from a location lying slightly above a location where the suction pipe penetrates the bottom portion as an originating point.

12 Claims, 3 Drawing Sheets

(58) Field of Classification Search
CPC ..... F25B 2313/0315; F25B 2341/066; F25B 2700/2106; F25B 2700/21152; F25B 2700/1931; F25B 43/02; F25B 43/00; F24F 1/32; F24F 1/42
See application file for complete search history.

(56) References Cited

U.S. PATENT DOCUMENTS

| | | | | |
|---|---|---|---|---|
| 5,596,881 | A * | 1/1997 | Wilson | B23P 11/005 29/509 |
| 5,887,444 | A | 3/1999 | Toyoshima et al. | |
| 2001/0032478 | A1 * | 10/2001 | McAllister | F25B 43/003 62/509 |
| 2008/0184727 | A1 * | 8/2008 | Innes | F25B 45/00 62/324.4 |
| 2009/0133435 | A1 * | 5/2009 | Toyoshima | F25B 43/006 62/473 |
| 2011/0308272 | A1 | 12/2011 | Toyoshima et al. | |
| 2011/0308273 | A1 | 12/2011 | Toyoshima et al. | |
| 2016/0178250 | A1 | 6/2016 | Jeung et al. | |

FOREIGN PATENT DOCUMENTS

| | | | |
|---|---|---|---|
| CN | 201407863 | Y | 2/2010 |
| CN | 202083159 | U | 12/2011 |
| CN | 102767925 | A | 11/2012 |
| CN | 203534000 | U | 4/2014 |
| CN | 104154689 | A | 11/2014 |
| CN | 106196776 | A | 12/2016 |
| EP | 1933103 | A1 | 6/2008 |
| JP | 2002-213843 | A | 7/2002 |
| JP | 2004-077033 | A | 3/2004 |
| JP | 2015-059696 | A | 3/2015 |
| WO | WO 2007/039951 | A1 | 4/2007 |

OTHER PUBLICATIONS

Jun. 22, 2020, European Search Report issued for related EP application No. 17878980.6.
Dec. 19, 2017, International Search Report issued for related PCT application No. PCT/JP2017/034092.
Dec. 19, 2017, International Search Opinion issued for related PCT application No. PCT/JP2017/034092.
Jul. 1, 2020, Chinese Office Action issued for related CN application No. 201780075133.7.

* cited by examiner

GAS-LIQUID SEPARATOR AND AIR CONDITIONER INCLUDING THE SAME

CROSS REFERENCE TO PRIOR APPLICATION

This application is a National Stage Patent Application of PCT International Patent Application No. PCT/JP2017/034092 (filed on Sep. 21, 2017) under 35 U.S.C. § 371, which claims priority to Japanese Patent Application No. 2016-235504 (filed on Dec. 5, 2016), which are all hereby incorporated by reference in their entirety.

TECHNICAL FIELD

The present invention relates to a swivel-type gas-liquid separator and an air conditioner including the same swivel-type gas-liquid separator.

BACKGROUND

A gas-liquid separator such as a receiver or an accumulator is provided in an outdoor unit of an air conditioner that tends to be loaded with a great amount of refrigerant such as a multi room-type air conditioner in which a plurality of indoor units are connected to one outdoor unit. For example, in an air conditioner described in Patent Literature 1, an accumulator made up of a cylindrical sealed container is provided in an outdoor unit. Then, a suction pipe, configured to let out a gas refrigerant from the accumulator to return the gas refrigerant to a suction side of a compressor, and an oil return pipe, configured to let out a refrigerator oil to return the refrigerator oil to an oil reservoir in the compressor, are both connected to a bottom portion of the accumulator. A gas-liquid two-phase refrigerant flowing into an interior of the accumulator is separated into a gas refrigerant and a liquid refrigerant, and a refrigerator oil within the accumulator. Then, the separated gas refrigerant is returned to the suction side of the compressor by way of the suction pipe, and the separated refrigerator oil is returned to the oil reservoir of the compressor by way of the oil return pipe.

As the accumulator described above, there is an accumulator adopting a so-called swivel-type approach. In this swivel-type accumulator, a gas-liquid two-phase refrigerant is caused to flow into the accumulator in a direction tangent to a wall surface of a sealed container of the accumulator to form a swirling current flowing in a circumferential direction of the wall surface of the sealed container. Then, the gas-liquid two-phase refrigerant is separated into a gas refrigerant, a liquid refrigerant and a refrigerator oil by virtue of a centrifugal force generated by the swirling current. In the swivel-type accumulator, the separated liquid refrigerant and refrigerator oil fall within the sealed container to be collected to remain at a bottom portion of the sealed container.

Then, with the bottom portion of the sealed container of the accumulator formed into, for example, a dome shape that projects downwards, the separated refrigerator oil can be collected to remain at a lowermost portion of the bottom portion. Then, the refrigerator oil separated in the accumulator can be returned to the compressor with good efficiency by connecting the oil return pipe described above to the lowermost portion, thereby making it possible to prevent the occurrence of a lubrication failure in the compressor.

PRIOR ART LITERATURE

Patent Literature

Patent Literature 1: JP-A 2015-59696

SUMMARY OF INVENTION

Technical Problem

In the case where the bottom portion of the sealed container of the accumulator is formed into the dome shape projecting downwards, that is, a shape in which a center axis of the cylindrical sealed container passes through the lowermost portion of the bottom portion, the refrigerator oil is collected to remain together with the liquid refrigerant at the lowermost portion. Then, with the oil return pipe connected to the lowermost portion, the refrigerator oil remaining in the accumulator can be returned to the compressor with no refrigerator oil left in the accumulator. As described above, however, since the oil return pipe and the suction pipe are connected to the lowermost portion of the bottom portion, in the case where the oil return pipe is connected to the lowermost portion of the bottom portion, the suction pipe is then connected to any other location than the lowermost portion of the bottom portion. Normally, a suction pipe connected to an accumulator is extended straight upwards so that an opening of the suction pipe is located in an upper portion of a sealed container, for example, in a portion near a space defined by a top portion of the sealed container so as to introduce only a separated refrigerant gas into the suction pipe.

With the suction pipe connected to any other location than the lowermost portion of the bottom portion of the sealed container as described above, in the case where an inside diameter of the sealed container of the accumulator is small or that a connecting portion of the suction pipe to the accumulator lies away from the lowermost portion of the bottom portion, there may be a case where the suction pipe is disposed near an inner wall surface of the sealed container in the sealed container. As this occurs, there are fears that the suction pipe within the sealed container interrupts the swirling current of gas-liquid two-phase refrigerant that flows into the accumulator to thereby weaken the centrifugal force generated by the swirling current, whereby gas and liquid are not separated sufficiently. As an approach for solving the problem, it is considered that the accumulator is enlarged diametrically so that the suction pipe can be disposed in a location lying away from the inner wall surface of the sealed container. However, this approach increase the size of the accumulator, leading to a problem in that the outdoor unit is increased in size, The invention has been made to solve the problems described above, and an object of the invention is to provide a gas-liquid separator configured to separate gas and liquid sufficiently without increase the size thereof and an air conditioner including the gas-liquid separator.

Solution to Problem

To solve the problem, a gas-liquid separator of the invention includes a sealed container formed by a main body portion having a cylindrical shape, a top portion covering an upper end side of the main body portion, and a bottom portion covering a lower end side of the main body portion, an inlet inner pipe, and a suction inner pipe, the inlet inner pipe and the suction inner pipe being disposed in an interior of the sealed container. The top portion includes an inlet pipe connecting portion continuing to the inlet inner pipe and constituting a connecting portion of an inlet pipe through which a gas-liquid two-phase fluid flows in. The bottom portion includes a suction pipe connecting portion continuing to the suction inner pipe and from which a gas of the gas-liquid two-phase fluid flows out and a liquid outlet pipe connecting portion from which a liquid of the gas-liquid two-phase fluid flows out. Then, the liquid outlet pipe connecting portion is disposed at a radially central portion of the bottom portion, and the suction pipe connecting portion is disposed at any other location than the central portion. The suction inner pipe has a bend portion formed by bending part of the suction inner pipe so that the suction inner pipe is disposed in an upper portion of a central portion.

Advantageous Effect of the Invention

In the gas-liquid separator of the invention configured as described above and the air conditioner including the gas-liquid separator, the suction inner pipe that is disposed in the interior of the gas-liquid separator can be disposed at the location lying away from an inner wall surface of the main body portion of the gas-liquid separator. Due to this, the suction inner pipe does not interrupt a swirling current, whereby gas and liquid are separated sufficiently by making use of a centrifugal force generated by the swirling current without increasing the size of the gas-liquid separator.

DESCRIPTION OF EMBODIMENT

Hereinafter, an embodiment of the invention will be described in detail based on accompanying drawings. As an embodiment, an air conditioner will be described in which an outdoor unit is connected to three indoor units, and an accumulator configured as a gas-liquid separator is provided in the outdoor unit. Note that the invention is not limited by the following embodiment and hence can be modified variously without departing from the spirit and scope of the invention.

Embodiment

Figure 1:
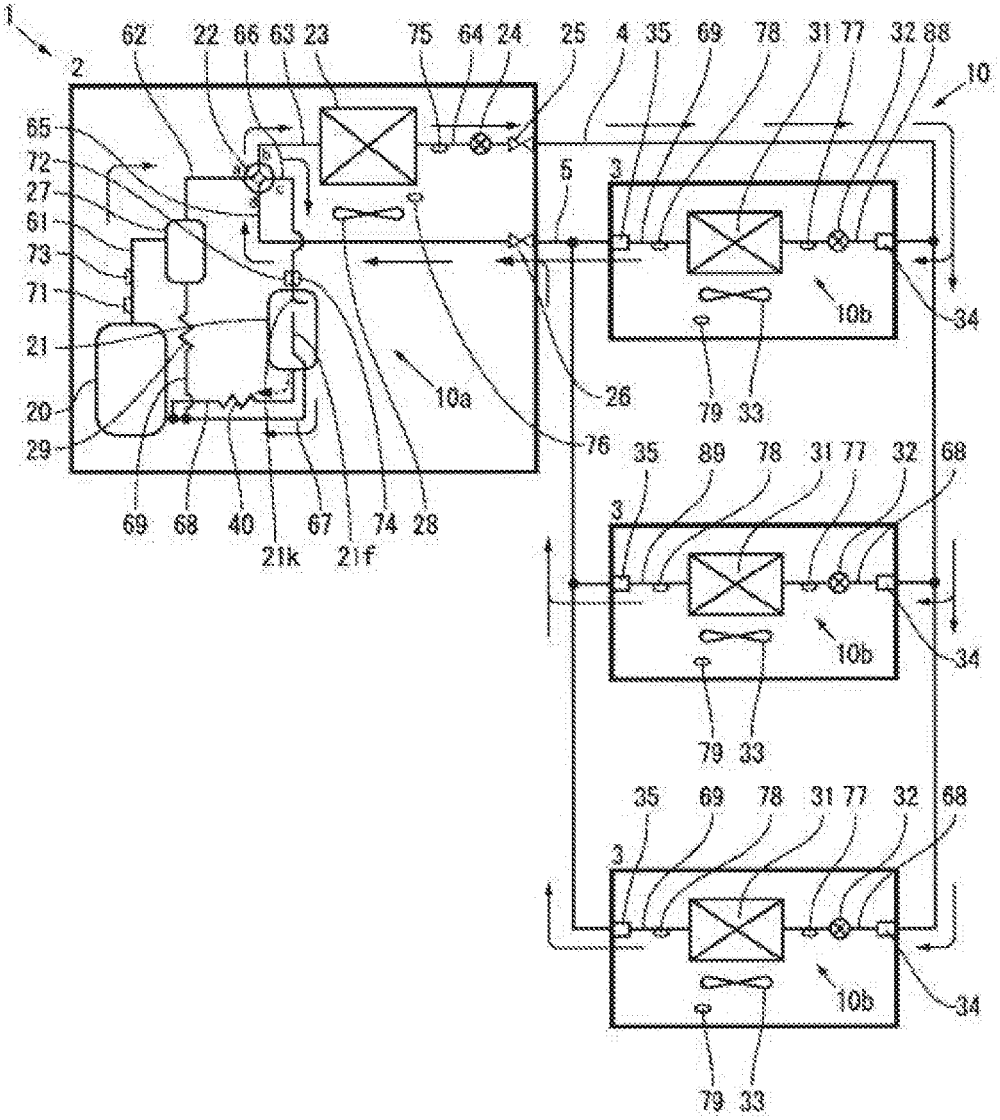
FIG. 1 is a refrigerant circuit diagram of an air conditioner according to an embodiment of the invention.

As shown in FIG. 1, an air conditioner 1 of this embodiment includes an outdoor unit 2 placed outside a building and indoor units 3 that are connected parallel to the outdoor unit 2 by a liquid pipe 4 and a gas pipe 5. To describe this in detail, the liquid pipe 4 is connected to a closure valve 25 of the outdoor unit 2 at one end and branches at the other end to be connected to liquid pipe connecting portions 34 of the indoor units 3. Additionally, the gas pipe 5 is connected to a closure value 26 in the outdoor unit 2 at one end and branches at the other end to be connected to gas pipe connecting portions 35 of the indoor units 3. A refrigerant circuit 10 of the air conditioner 1 is formed by the configuration described above.

Firstly, the outdoor unit 2 will be described. The outdoor unit 2 includes a compressor 20, an oil separator 27, a four-way valve 22, an outdoor heat exchanger 23, an outdoor expansion valve 24, the closure valve 25 to which the liquid pipe 4 is connected at the one end, the closure valve 26 to which the gas pipe 5 is connected at the one end, an accumulator 21 and an outdoor fan 28. Then, these devices excluding the outdoor fan 28 are connected to one another by individual refrigerant pipings, which will be described below in detail, to make up an outdoor unit refrigerant circuit 10*a* constituting part of the refrigerant circuit 10.

Figure 3:
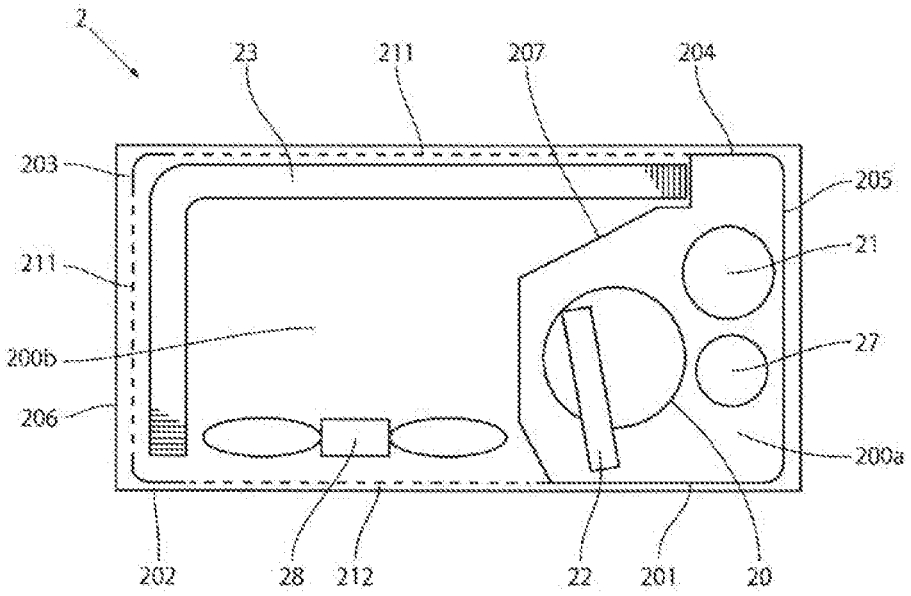
FIG. 3 is a plan view of an interior of an outdoor unit according to the embodiment of the invention.

As shown in FIG. 3, the outdoor unit 2 is made up of a rectangular parallelepiped housing including a front panel 201, a front side post 202, a rear side post 203, a rear panel 204, a side panel 205, a bottom plate 206, a partition plate 207, and a top panel, not shown.

The front panel 201 is formed of sheet metal and is disposed to cover a part of a right side of a front face of the outdoor unit 2 (a front face of a machine compartment 200*a*, which will be described later). The front side post 202 is made by forming sheet metal into an L-shape and is disposed at a left end of the front face of the outdoor unit 2. Then, a space between a left end of the front panel 201 and the front side post 202 is configured as a blow-out opening 212 through which an interior of the outdoor unit 2 communicates with an exterior thereof. The outdoor fan 28 is disposed in such a manner as to face the blow-out opening 212.

The rear side post 203 is made by forming sheet metal into an L-shape and is disposed at a left end of a rear face of the outdoor unit 2. The rear panel 204 is formed of sheet metal and is disposed to cover a part of a right side of the rear face of the outdoor unit 2 (a rear face of the machine compartment 200*a*, which will be described later). Then, a space between the front side post 202 and the rear side post 203 and a space between the rear side post 203 and a left end of the rear panel 204 are configured as a suction opening 211 through which the interior of the outdoor unit 2 communicates with the exterior thereof. The outdoor heat exchanger 23 is disposed in such a manner as to face the suction opening 211.

The side panel 205 is formed of sheet metal and is disposed in such a manner as to cover a right side face of the outdoor unit 2. The partition plate 207 is formed by bending sheet metal substantially into a C-shape and divides an interior of the housing of the outdoor unit 2 into the machine compartment 200*a* and a heat exchanging compartment 200*b*. The bottom plate 206 is formed into a box shape by bending a circumferential edge portion of sheet metal upwards. The panels that have been described above and the partition plate 207 are fixed on to the bottom plate 206.

The devices making up the outdoor unit refrigerant circuit 10*a* are disposed in an interior of the housing of the outdoor unit 2 that has been described above. Specifically, the compressor 20, the oil separator 27, the four-way valve 22 and the accumulator 21 are disposed within the machine compartment 200*a*. Note that although the outdoor expansion valve 24, the closure valves 25, 26, the refrigerant pipings, and electrical equipment, not shown, are also disposed in the machine compartment 200*a*, they are not shown in FIG. 3. On the other hand, the outdoor heat exchanger 23 and the outdoor fan 28 are disposed in the heat exchanging compartment 200*b*. As described above, the outdoor heat exchanger 23 is disposed in such a manner as to face the suction opening 211, and the outdoor fan 28 is disposed in such a manner as to face the blow-out opening 212.

Next, individual configurations of the outdoor unit refrigerant circuit 10*a* will be described. The compressor 20 constitutes a capacity variable compressor of which an operation capacity is variable by being driven by a motor, not shown, of which a rotation speed is controlled by an inverter. A refrigerant outlet side of the compressor 20 is connected to a refrigerant inlet port of the oil separator 27, which will be described later, by way of a discharge pipe 61. Additionally, a refrigerant inlet side of the compressor 20 is connected to a suction pipe connecting portion 21*j* provided at a bottom portion 21*c*, which will be described later, of the accumulator 21 by way of a suction pipe 67.

The refrigerant inlet port of the oil separator 27 is connected to the refrigerant outlet side of the compressor 20 by way of the discharge pipe 61, and a refrigerant outlet port of the oil separator 27 is connected to a port a of the four-way valve 22 by way of an outlet pipe 62. Additionally, an oil outlet port of the oil separator 27 is connected to the suction pipe 67 described above by way of an oil return pipe 69 including a first capillary tube 29. This oil return pipe 69 causes a refrigerant oil discharged together with a refrigerant from the compressor 20 and separated from the refrigerant in the oil separator 27 to be sucked into the compressor 20 by way of the suction pipe 67. As this occurs, while the refrigerant flows into the oil return pipe 69 together with the refrigerator oil from the oil separator 27, an amount of refrigerant that flows into the compressor 20 by way of the suction pipe 67 is restricted by the first capillary tube 29.

The four-way valve 22 is a valve configured to switch over directions in which the refrigerant flows and includes four ports of a, b, c and d. The port a is connected to the refrigerant outlet port of the oil separator 27 by way of the outlet pipe 62 as described above. The port b is connected to one of refrigerant outlet/inlet ports of the outdoor heat exchanger 23 by way of a refrigerant piping 63. The port c is connected to an inlet pipe connecting portion 21*n* provided at a top portion 21*b*, which will be described later, of the accumulator 21 by way of an inlet pipe 66. Then, the port d is connected to the closure valve 26 by way of an outdoor unit gas piping 65.

The outdoor heat exchanger 23 transfers heat between the refrigerant and an outside air taken into the heat exchanging compartment 200*b* as a result of rotation of the outdoor fan 28. The one of the refrigerant outlet/inlet ports of the outdoor heat exchanger 23 is connected to the port b of the four-way valve 22 by way of the refrigerant piping 63, and the other outlet/inlet port of the outdoor heat exchanger 23 is connected to the closure valve 25 by way of an outdoor unit liquid pipe 64.

The outdoor expansion valve 24 is provided on the outdoor unit liquid pipe 64. The outdoor expansion valve 24 is an electronic expansion valve and controls an amount of refrigerant flowing into the outdoor heat exchanger 23 or an amount of refrigerant flowing out from the outdoor heat exchanger 23 by controlling the opening thereof. The outdoor expansion valve 24 is fully opened when the air conditioner 1 performs a cooling operation. Additionally, when the air conditioner 1 performs a heating operation, the opening of the outdoor expansion valve 24 is controlled according to a discharge temperature of the compressor 20 that is detected by a discharge temperature sensor 73, which will be described later, so that the discharge temperature does not exceed a performance upper limit value of the compressor 20.

The outdoor fan 28 is formed from a resin material and is disposed in such a manner as to face the blow-out opening 212 as described above. The outdoor fan 28 is driven to rotate by a fan motor, not shown, to take outside air from the suction opening 211 into the heat exchanging compartment 200*b* and discharges the outside air to which heat is transferred from the refrigerant to an exterior of the outdoor unit 2 from the blow-out opening 212.

As described above, in the accumulator 21, the inlet pipe connecting portion 21*n* is connected to the port c of the four-way valve 22 by way of the inlet pipe 66, and the suction pipe connecting portion 21*j* is connected to the refrigerant inlet side of the compressor 20 by way of the suction pipe 67. Additionally, although details will be described later, the oil outlet pipe connecting portion 21*p* provided at the bottom portion 21*c* of the accumulator 21 is connected to the suction pipe 67 described above by way of an oil outlet pipe 68, and a second capillary tube 40 is provided on the oil outlet pipe 68 to limit an amount of refrigerant flowing from the oil outlet pipe 68 into the compressor 20 by way of the suction pipe 67. The accumulator 21 separates a gas-liquid two-phase refrigerant that flows into an interior of the accumulator 21 from the inlet pipe 66 into a gas refrigerant and a liquid refrigerant containing a refrigerator oil and causes the gas refrigerant and the liquid refrigerant and the refrigerator oil to be sucked into the compressor 20 by way of the suction pipe 67 and by way of the oil outlet pipe 68 and the suction pipe 67, respectively. The structure of the accumulator 21 will be described in detail later by use of FIG. 2.

In addition to the configuration that has been described heretofore, various types of sensors are provided in the outdoor unit 2. As shown in FIG. 1, a high pressure sensor 71 configured to detect a pressure of the refrigerant discharged from the compressor 20 and the discharge temperature sensor 73 configured to detect a temperature of the refrigerant discharged from the compressor 20 are provided on the discharge pipe 61. A low pressure sensor 72 configured to detect a pressure of the refrigerant sucked into the compressor 20 and a suction temperature sensor 74 configured to detect a temperature of the refrigerant sucked into the compressor 20 are provided on the inlet pipe 66.

A heat exchange temperature sensor 75 configured to detect a temperature of the refrigerant flowing out of the outdoor heat exchanger 23 or a temperature of the refrigerant flowing into the outdoor heat exchanger 23 is provided between the outdoor heat exchanger 23 and the outdoor expansion valve 24 on the outdoor unit liquid pipe 64. Then, an outside air temperature sensor 76 configured to detect a temperature of outside air flowing into the heat exchanging compartment 200*b*, that is, an outside air temperature is provided near the suction opening 211 of the outdoor unit 2.

Next, the three indoor units 3 will be described by use of FIG. 1. The three indoor units 3 all have the same configuration and air conditioning capacity and each include an indoor heat exchanger 31, an indoor expansion valve 32, the liquid pipe connecting portion 34 to which the other end of the liquid pipe 4 is connected, the gas pipe connecting portion 35 to which the other end of the gas pipe 5 is connected, and an indoor fan 33. Then, these devices excluding the indoor fan 33 are connected to one another by refrigerant pipings, which will be described in detail below to thereby make up an indoor unit refrigerant circuit 101*b* constituting part of the refrigerant circuit 10.

The indoor heat exchanger 31 transfers heat between the refrigerant and an inside air taken into an interior of the indoor heat exchanger 31 from a suction opening, not shown, as a result of rotation of the indoor fan 33. One of refrigerant outlet/inlet port of the heat exchanger 31 is connected to the liquid pipe connecting portion 34 by way of an indoor unit liquid pipe 88, and the other refrigerator outlet/inlet port of the heat exchanger 31 is connected to the gas pipe connecting portion 35 by way of an indoor unit gas pipe 89. With the indoor unit 3 performing a cooling operation, the indoor unit 3 functions as an evaporator, while with the indoor unit 3 performing a heating operation, the indoor unit 3 functions as a condenser. Note that the refrigerant pipings are connected through welding or using flare nuts at the liquid pipe connecting portion 34 and the gas pipe connecting portion 35.

The indoor expansion valve 32 is provided on the indoor unit liquid pipe 88. The indoor expansion valve 32 is an electronic expansion valve. With the indoor heat exchanger 31 functioning as the evaporator, the opening of the indoor expansion valve 32 is controlled according to a required cooling capacity, while with the indoor heat exchanger 31 functioning as the condenser, the opening of the indoor expansion valve 32 is controlled according to a required heating capacity.

The indoor fan 33 is formed from a resin material and is disposed near the indoor heat exchanger 31. The indoor fan 33 is driven to rotate by a fan motor, not shown, to take inside air from a suction opening, not shown, into an interior of the indoor unit 3 and blows out the inside air to which the heat of the refrigerant is transferred from a blow-out opening, not shown, into a room.

In addition to the configuration that has been described heretofore, various types of sensors are provided in the indoor unit 3. A liquid side temperature sensor 77 configured to detect a temperature of the refrigerant that flows into the indoor heat exchanger 31 or flows out of the indoor heat exchanger 31 is provided between the indoor heat exchanger 31 and the indoor expansion valve 32 on the indoor unit liquid pipe 88. A gas side temperature sensor 78 configured to detect a temperature of the refrigerant that flows out of the indoor heat exchanger 31 or flows into the indoor heat exchanger 31 is provided on the indoor unit gas pipe 89. Then, a room temperature sensor 79 configured to detect a temperature of inside air that flows into the indoor unit 3, that is, a room temperature is provided near the suction opening, not shown, of the indoor unit 3.

Next, flows of the refrigerant and operations of the devices in the refrigerant circuit 10 while the air conditioner 1 of this embodiment is performing an air conditioning operation will be described by use of FIG. 1. Not that in the following description, the three indoor units 3 will be described as performing a cooling operation, and a detailed description of a heating operation performed by the three indoor units 3 will be omitted. Additionally, in FIG. 1, arrows denote flows of the refrigerant when the cooling operation is performed.

As shown in FIG. 1, when the three indoor units 3 perform a cooling operation, the four-way valve 22 is switched to a state indicated by solid lines, that is, so that the port a communicates with the port b and the port c communicates with the port d of the four-way valve 22. As a result of the four-way valve 22 being switched to the state described above, the outdoor heat exchanger 23 functions as the condenser, and the individual indoor heat exchangers 31 function as the evaporators.

The highly pressurized refrigerant discharged from the compressor 20 flows through the discharge pipe 61 into the oil separator 27. The refrigerant discharged from the compressor 20 contains the refrigerator oil remaining in the compressor 20. This refrigerator oil is separated from the refrigerant in the oil separator 27, whereby only the refrigerant flows out of the oil separator 27 into the outlet pipe 62. The refrigerator oil separated from the refrigerant in the oil separator 27 flows out from the oil separator 27 into the oil return pipe 69 and then flows into the suction pipe 67 by way of the first capillary tube 29. Then, the refrigerator oil flowing through the suction pipe 67 is sucked into the compressor 20.

The refrigerant flowing out from the oil separator 27 into the outlet pipe 62 flows into the four-way valve 22 and then flows from the four-way valve 22 through the refrigerant piping 63 into the outdoor heat exchanger 23. The refrigerant flowing into the outdoor heat exchanger 23 transfers its heat to outside air taken into the heat exchanging compartment **200*b* from the suction opening 211 of the outdoor unit 2 by the rotation of the outdoor fan 28 to condense. The refrigerant flowing out of the outdoor heat exchanger 23 flows through the outdoor unit liquid pipe 64 into the liquid pipe 4 by way of the outdoor expansion valve 24 that is fully opened and the closure valve 25**.

The refrigerant that flows through the liquid pipe 4 into the individual indoor units 3 then flows through the individual indoor unit liquid pipes 88. Then, when the refrigerant passes through the individual indoor expansion valves 32, the refrigerant is depressurized to become a low pressure refrigerant. The refrigerant flows from the individual indoor unit liquid pipes 88 into the individual heat exchangers 31, where heat is transferred between the refrigerant and inside air taken into respective interiors of the indoor units 3 by rotation of the individual indoor fans 33, whereby the refrigerant is evaporated. In this way, the individual indoor heat exchangers 31 function as evaporators, and the inside air of which heat is transferred to the refrigerant in the individual indoor heat exchangers 31 is blown out from blow-out openings, not shown, of the corresponding indoor heat exchangers 31 into the rooms where the indoor units 3 are placed, whereby the rooms where the indoor units 3 are placed are cooled.

The refrigerant flowing out of the individual indoor heat exchangers 31 flows through the individual indoor unit gas pipes 89 into the gas pipe 5. The refrigerant flowing through the gas pipe 5 into the outdoor unit 2 by way of the closure valve 26 then flows into the accumulator 21 by way of the outdoor unit gas piping 65, the four-way valve 22, and the inlet pipe 66. A gas-liquid two-phase refrigerant containing the refrigerator oil remaining in the refrigerant circuit 10 flows into the accumulator 21 and is separated into a gas refrigerant and a liquid refrigerant containing a refrigerator oil in the interior of the accumulator 21.

The gas refrigerant separated in the accumulator 21 flows out into the suction pipe 67 and is then sucked from the suction pipe 67 into the compressor 20 where the refrigerant is compressed again. On the other hand, although the liquid refrigerant and the refrigerator oil separated in the accumulator 21 remain at the bottom portion 21, which will be described later, of the accumulator 21, the remaining liquid refrigerant and refrigerator oil flow through the oil outlet pipe 68 and is then sucked into the compressor 20. At this time, flow rates of the liquid refrigerant and the refrigerator oil in the oil outlet pipe 68 are restricted by the second capillary tube 40 provided on the oil outlet pipe 68.

When the individual indoor units 3 perform a heating operation, the four-way valve 22 is switched to a state indicted by broken lines, that is, so that the port a communicates with the port d and the port b communicates with the port c of the four-way valve 22. As a result of the four-way valve 22 being switched so, the outdoor heat exchanger 23 functions as the evaporator, and the indoor heat exchangers 31 function as the condensers.

Next, the structure of the accumulator 21 will be described in detail by use of FIG. 2.

Figure 2:
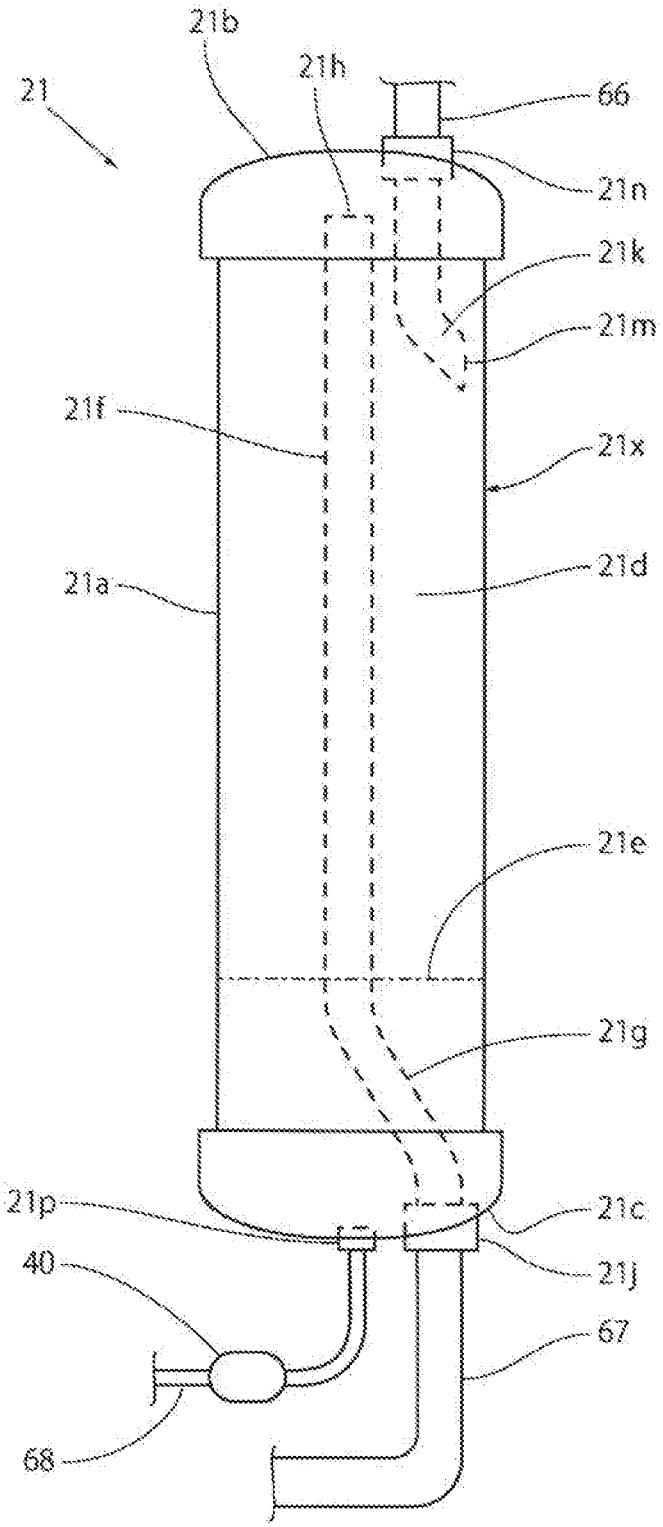
FIG. 2 is a schematic diagram of an accumulator constituting a gas-liquid separator according to the embodiment of the invention.

As shown in FIG. 2, the accumulator 21 includes a sealed container 21*x*, which is made up of a main body portion 21*a* made by forming an iron material into a cylindrical shape, and the top portion 21*b* and the bottom portion 21*c* that are both made by forming an iron material into a dome shape (one of faces having an arc shape) in such a manner as to cover an upper opening portion and a lower opening portion of the main body portion 21*a*, respectively. Then, a suction inner pipe 21*f* and an inlet inner pipe 21*k* are disposed in an interior of the sealed container 21*x*.

The inlet inner pipe 21*k* is connected to the inlet pipe 66 via the inlet pipe connecting portion 21*n* provided at a location that is offset towards an outer circumferential side from an apex portion (a center portion of the dome-shaped portion) of the top portion 21*b* of the accumulator 21. The inlet inner pipe 21*k* is formed in such a manner as to extend downwards in a straight line from a connecting portion with the inlet pipe connecting portion 21*n*, whereby the inlet inner pipe 21*k* is prevented from interfering with the suction inner pipe 21*f*, which will be described later. Then, a lower end portion of the inlet inner pipe 21*k* is bent towards an inner wall side of the main body portion 21*a* so that a gas-liquid two-phase refrigerant flowing out from an outlet port 21*m*, which is a lower end side opening of the inlet inner pipe 21*k*, flows in a circumferential direction along the inner wall side of the main body portion 21*a*.

The oil outlet pipe 68 is connected to the oil outlet pipe connecting portion 21*p* provided at an apex portion (a center portion of the dome-shaped portion) of the bottom portion 21*c* of the accumulator 21. The suction inner pipe 21*f* makes the suction pipe 67 via the suction pipe connecting portion 21*j* provided at a location that is offset towards an outer circumferential side from the apex portion of the bottom portion 21*c*.

The suction inner pipe 21*f* extends as far as an upper portion of the main body portion 21*a* so that an inlet port 21*h*, which is an opening portion of the suction inner pipe 21*f*, is disposed in an interior space of the sealed container 21*x* defined by the top portion 21*b*, whereby the inlet port 21*h* is disposed in a position higher than the Outlet port 21*m* of the inlet inner pipe 21*k*. Then, the suction inner pipe 21*f* includes a bend portion 21*g* that bends from a portion located slightly above the suction pipe connecting portion 21*j* below a boundary surface 21*e*, which will be described later, as an originating point so that the most of the suction inner pipe 21*f* is disposed above the apex portion of the bottom portion 21*c*, that is, on a center axis of the main body portion 21*a*.

In the accumulator 21 configured as described above, a gas-liquid two-phase refrigerant containing a refrigerator oil that flows through the inlet pipe 66 flows through the inlet inner pipe 21*k* into the main body portion 21*a* from the outlet port 21*m*. At this time, as has been described before, since the lower end portion of the inlet inner pipe 21*k* is bent towards the inner wall side of the main body portion 21*a*, the gas-liquid two-phase refrigerant that flows into the main body portion 21*a* from the outlet port 21*m* constitutes a swirling current that flows in a circumferential direction along an inner wall surface of the main body portion 21*a*.

Then, the gas-liquid two-phase refrigerant is separated into a gas refrigerant, a liquid and a refrigerator oil by virtue of a centrifugal force generated by the swirling current. The separated gas refrigerant is sucked in to the suction inner pipe 21*f* from the inlet port 21*h* and flows out of the accumulator 21 into the suction pipe 67 by way of the bend portion 21*g* and the suction pipe connecting portion 21*j*. The gas refrigerant that flows into the suction pipe 67 is sucked into the compressor 20 as described above.

On the other hand, the liquid refrigerant and the refrigerator oil that are separated in the interior of the main body portion 21*a* fall down in the interior of the main body portion 21*a* to be collected and remain at the bottom portion 21*c*. At this time, as described before, since the inlet port 21*h* of the suction inner pipe 21*f* is disposed in the position higher than the outlet port 21*m* of the inlet pipe 66, the separated liquid refrigerant and refrigerator oil never flow out into the suction pipe 67 by way of the inlet port 21*h*.

The refrigerator oil collected and remaining at the bottom portion together with the liquid refrigerant flows into the oil outlet pipe 68 by way of the oil outlet pipe connecting portion 21*p* and is then returned to the compressor 20. Specifically, the liquid refrigerant and refrigerator oil collected and remaining at the bottom portion 21*c* flow out into the oil outlet pipe 68, and the liquid refrigerant and refrigerator oil are restricted in flow rate at the second capillary tube 49 and then continue to flow into the suction pipe 67 from the oil outlet pipe 68 to be sucked into the compressor 20. As described above, the oil outlet pipe 68 is connected to the apex portion of the bottom portion 21*c* of the accumulator 21, and the apex portion of the bottom portion 21*c* constitutes a lowermost portion of the accumulator 21. Thus, the liquid refrigerant and refrigerator oil collected to remain at the bottom portion 21*c* can be returned to the compressor 20 with no liquid refrigerant and refrigerator oil left at the bottom portion 21*c*. The refrigerator oil sucked in the compressor 20 flows to a compressing portion, not shown, together with the gas refrigerant flowing into the interior of the compressor 20 from the suction pipe 67. Then, the gas refrigerant falls down in the compressor 20 during a period from the gas refrigerant is compressed in the compressing portion until the gas refrigerant is discharged from the discharge pipe 61 to be reserved in an oil reservoir, not shown, provided at a lower portion of the compressor 20.

The bend portion 21*g* is provided on the suction inner pipe 21*f* so as to be disposed above the oil outlet pipe connecting portion 21*p*, that is, so as to be disposed on the center axis of the main body portion 21*a*. As described above, the gas-liquid two-phase refrigerant is separated into the gas refrigerant and the refrigerator oil by the virtue of the centrifugal force generated by the swirling current in the interior of the accumulator 21, and an area where the gas-liquid separation is executed by the centrifugal force is a swirling area 21*d* shown in FIG. 2. This swirling area 21*d* is found through experiments carried out in advance as an area where gas and liquid are separated sufficiently by the swirling current (almost all the gas-liquid two-phase refrigerant that flows into the accumulator 21 is separated into the gas refrigerant and the liquid refrigerant containing the refrigerator oil) in an area defined as down as a boundary surface 21*e* (an imaginary surface situated a predetermined dimension away from the top portion 21*b*) in the interior of the accumulator 21.

Then, the suction inner pipe 21*f* is disposed at a location (on the center axis of the main body portion 21*a* as described above) spaced away from the inner wall surface of the main body portion 21*a* by disposing the bend portion 21*g* of the suction inner pipe 21*f* below the swirling area 21*d*. Due to this, the suction inner pipe 21*f* and the bend portion 21*g* are prevented from interrupting the swirling current of the gas-liquid two-phase refrigerant that flows from the outlet port 21*m* of the inlet inner pipe 21*k* into the interior of the sealed container 21*x*, and hence, the suction inner pipe 21*f* and the bend portion 21*g* are prevented from interrupting the separation of the gas-liquid two-phase refrigerant into the gas refrigerant, the liquid refrigerant and the refrigerator oil by the action of the centrifugal force generated by the swirling current.

In the case where the suction pipe connecting portion 21*j* is provided at the location that is offset towards the outer circumferential side from the appex portion of the bottom portion 21*c*, and the suction inner pipe 21*f* is connected to the suction pipe connecting portion 21*j*, in the event that the suction inner pipe 21*f* is formed in such a manner as to extend upwards in a straight line without providing the bend portion 21*g*, which is provided in the invention, the suction inner pipe 21*f* is disposed near the inner wall surface of the main body portion 21*a* to interrupt the swirling current. To solve this problem, the suction inner pipe 21*f* should be spaced away from the inner wall surface of the main body portion 21*a* by increasing the radial dimension of the main body portion 21*a*; however, this increases the radial dimension of the accumulator 21. Then, the space inside the machine compartment 200*a* is also enlarged by disposing the accumulator 21 of which the radial dimension is increased in the machine compartment 200*a* of the outdoor unit 2 shown in FIG. 3, whereby the outdoor unit 2 is eventually enlarged in size.

In addition, when the radial dimension of the accumulator 21 is increased, the speed of the swirling current of the gas-liquid two-phase refrigerant that flows from the outlet port 21*m* of the inlet pipe 66 into the interior of the main body portion 21*a* is reduced, this reduces the action of the centrifugal force generated by the swirling current, leading to fears that the gas-liquid two-phase refrigerant cannot be separated into the gas refrigerant, the liquid refrigerant and the refrigerator oil sufficiently.

To deal with the problems described above, in the air conditioner of the invention, the radial dimension of the main body portion 21*a* can be decreased by providing the bend portion 21*g* on the suction inner pipe 21*f* so that the suction inner pie 21*f* is disposed on the center axis of the main body portion 21*a*. Consequently, the enlargement in size of the accumulator 21 and hence the enlargement in size of the outdoor unit 2 can be prevented. In addition, the speed of the swirling current of the gas-liquid two-phase refrigerant that flows from the outlet port 21*m* of the inlet pipe 21*k* into the interior of the main body portion 21*a* can be increased, whereby the gas-liquid two-phase refrigerant cannot be separated into the gas refrigerant, the liquid refrigerant and the refrigerator oil with good efficiency.

In the embodiment of the invention that has been described heretofore, the accumulator is described as being the gas-liquid separator. However, the invention can also be applied to different gas-liquid separators where gas and liquid are separated by making use of a centrifugal force generated by a swirling current such as a receiver tank or an oil separator that are provided on a high-pressure side of a refrigerant circuit.

While the invention has been described in detail by reference to the specific embodiment, it is obvious to those skilled in the art that various alterations or modifications can be made thereto without departing from the spirit and scope of the invention.

DESCRIPTION OF REFERENCE SIGNS

1 Air conditioner
2 Outdoor unit
3 Indoor unit
10 Refrigerant circuit
20 Compressor
21 Accumulator
21*a* Main body portion
21*b* Top portion
21*c* Bottom portion
21*d* Swirling area
21*e* Boundary surface
21*f* Suction inner pipe
21*g* Bend portion
21*h* Inlet port
21*j* Suction pipe connecting portion
21*k* Inlet inner pipe
21*m* Outlet port
21*n* Inlet pipe connecting portion
21*p* Oil outlet pipe connecting portion
21*x* Sealed container
22 Four-way valve
23 Outdoor heat exchanger
27 Oil separator
28 Outdoor fan
29 First capillary tube
40 Second capillary tube
66 Inlet pipe
67 Suction pipe
68 Oil outlet pipe
200*a* Machine compartment
200*b* Heat exchanging compartment

The invention claimed is:

1. A gas-liquid separator comprising:

a sealed container formed by a main body portion having a cylindrical shape, a top portion covering an upper end side of the main body portion, and a bottom portion covering a lower end side of the main body portion;

an inlet inner pipe; and a suction inner pipe, the inlet inner pipe and the suction inner pipe being disposed in an interior of the sealed container, wherein the top portion comprises an inlet pipe connecting portion continuing to the inlet inner pipe and constituting a connecting portion of an inlet pipe through which a gas-liquid two-phase fluid flows in, wherein the bottom portion comprises a suction pipe connecting portion continuing to the suction inner pipe and from which a gas of the gas-liquid two-phase fluid flows downward and out, and a liquid outlet pipe connecting portion from which a liquid of the gas-liquid two-phase fluid flows downward and out, wherein the liquid outlet pipe connecting portion is disposed at an apex portion of the bottom portion, which is a lowest downward position of the bottom portion and which is located at a radially central portion of the bottom portion, and the suction pipe connecting portion is disposed at any other location than the central portion, wherein the suction inner pipe has a straight portion and a bend portion that is formed by bending part of the suction inner pipe, the straight portion is disposed along a center axis of the main body portion of the sealed container, and the bend portion allowing the suction inner pipe to be disposed in an upper portion of a central portion, wherein the straight portion of the suction inner pipe is disposed within a swirling area in the main body portion where the gas-liquid separation by a swirling current due to the gas-liquid two-phase fluid flowing in a circumferential direction along an inner wall surface of the main body portion, which has flowed into the main body portion from an outlet provided at a lower end of the inlet inner pipe, is sufficiently performed, wherein the straight portion of the suction inner pipe is disposed above a boundary surface, the boundary surface defining a lower boundary of the swirling area and located a predetermined distance from the top portion of the sealed container, and wherein the bend portion of the suction inner pipe connects between the straight portion of the suction inner pipe and the suction pipe connecting portion.

2. The gas-liquid separator according to claim 1, wherein in the sealed container, an area defined from the top portion to the boundary surface constitutes the swirling area where the gas-liquid two-phase refrigerant flowing from the inlet pipe into the sealed container is made into the swirling current, causing the gas-liquid two-phase refrigerant to be separated into gas and liquid, and wherein the bend portion is disposed further downwards than the boundary surface.

3. An air conditioner comprising:

an outdoor unit comprising the gas-liquid separator, the inlet pipe and a compressor according to claim 2; and an indoor unit connected with the outdoor unit by way of a refrigerant piping, wherein the suction pipe connecting portion of the gas-liquid separator is connected with the compressor by way of the suction pipe.

4. The gas-liquid separator according to claim 2, wherein the bend portion is disposed further downwards within the interior of the sealed container than the boundary surface.

5. An air conditioner comprising:

an outdoor unit comprising the gas-liquid separator, the inlet pipe and a compressor according to claim 1; and an indoor unit connected with the outdoor unit by way of a refrigerant piping, wherein the suction pipe connecting portion of the gas-liquid separator is connected with the compressor by way of the suction pipe.

6. The gas-liquid separator according to claim 1, wherein a top portion of the suction inner pipe is disposed within the interior of the sealed container and along the center axis of the main body portion of the sealed container.

7. The gas-liquid separator according to claim 6, wherein a bottom portion of the suction inner pipe is disposed within the interior of the sealed container and offset from the center axis of the main body portion of the sealed container.

8. The gas-liquid separator according to claim 7, wherein the bend portion is provided between the top portion and the bottom portion of the suction inner pipe.

9. The gas-liquid separator according to claim 1, wherein the bend portion of the suction inner pipe is disposed completely within the interior of the sealed container and allows the suction inner pipe to be disposed in a radially central portion of the upper portion of the sealed container.

10. The gas-liquid separator according to claim 1, wherein the bottom portion is formed as a dome shape projecting downwards, and the apex portion of the bottom portion is the lowest downward position of the dome-shaped bottom portion.

11. A gas-liquid separator comprising:

a sealed container formed by a main body portion having a cylindrical shape, a top portion covering an upper end side of the main body portion, and a bottom portion covering a lower end side of the main body portion;

an inlet inner pipe; and a suction inner pipe, the inlet inner pipe and the suction inner pipe being disposed in an interior of the sealed container, wherein the top portion comprises an inlet pipe connecting portion continuing to the inlet inner pipe and constituting a connecting portion of an inlet pipe through which a gas-liquid two-phase fluid flows in, wherein the bottom portion comprises a suction pipe connecting portion continuing to the suction inner pipe and from which a gas of the gas-liquid two-phase fluid flows out, and a liquid outlet pipe connecting portion from which a liquid of the gas-liquid two-phase fluid flows out, wherein the liquid outlet pipe connecting portion is disposed at a radially central portion of the bottom portion, and the suction pipe connecting portion is disposed at any other location than the central portion, wherein the suction inner pipe has a straight portion and a bend portion that is formed by bending part of the suction inner pipe, the straight portion is disposed along a center axis of the main body portion of the sealed container, and the bend portion is disposed below a swirling area in the main body portion where the gas-liquid separation by a swirling current due to the gas-liquid two-phase fluid flowing in a circumferential direction along an inner wall surface of the body, which has flowed into the body portion from an outlet provided at a lower end of the inlet inner pipe, is sufficiently performed, wherein the straight portion of the suction inner pipe is disposed within the swirling area and above a boundary surface, the boundary surface defining a lower boundary of the swirling area and located a predetermined distance from the top portion of the sealed container, and wherein the bend portion of the suction inner pipe connects between the straight portion of the suction inner pipe and the suction pipe connecting portion.

12. A gas-liquid separator comprising:

a sealed container formed by a main body portion having a cylindrical shape, a top portion covering an upper end side of the main body portion, and a bottom portion covering a lower end side of the main body portion;

an inlet inner pipe; and a suction inner pipe, the inlet inner pipe and the suction inner pipe being disposed in an interior of the sealed container, wherein the top portion comprises an inlet pipe connecting portion continuing to the inlet inner pipe and to which an inlet pipe for inflowing a gas-liquid two-phase fluid into the inlet inner pipe is connected, wherein the bottom portion comprises a suction pipe connecting portion continuing to the suction inner pipe and to which the suction pipe to which a gas of the gas-liquid two-phase fluid flows out of the inlet inner pipe is connected, and a liquid outlet pipe connecting portion to which an oil outlet pipe to which a liquid of the gas-liquid two-phase fluid flows is connected, wherein the liquid outlet pipe connecting portion is disposed at a radially central portion of the bottom portion, and the suction pipe connecting portion is disposed at any other location than the central portion, wherein the suction inner pipe has a straight portion and a bend portion that is formed by bending part of the suction inner pipe, the straight portion being disposed along a center axis of the main body portion of the sealed container, and the bend portion allowing the suction inner pipe to be disposed in an upper portion of a central portion;

wherein the straight portion of the suction inner pipe is disposed within a swirling area in the main body portion where the gas-liquid separation by a swirling current due to the gas-liquid two-phase fluid flowing in a circumferential direction along an inner wall surface of the main body portion, which has flowed into the main body portion from an outlet provided at a lower end of the inlet inner pipe, is sufficiently performed, wherein the straight portion of the suction inner pipe is disposed above a boundary surface, the boundary surface defining a lower boundary of the swirling area and located a predetermined distance from the top portion of the sealed container, and wherein the bend portion of the suction inner pipe connects between the straight portion of the suction inner pipe and the suction pipe connecting portion.

* * * * *